US012233997B1

(12) United States Patent
Nyren

(10) Patent No.: US 12,233,997 B1
(45) Date of Patent: Feb. 25, 2025

(54) JACK PLATE SYSTEM WITH PRECISION ADJUSTMENT AND OPTIMIZATION FEATURES

(71) Applicant: Nyren, LLC, St. Cloud, MN (US)

(72) Inventor: Gary Nyren, St. Augusta, MN (US)

(73) Assignee: Nyren, LLC, St. Cloud, MN (US)

( * ) Notice: Subject to any disclaimer, the term of this patent is extended or adjusted under 35 U.S.C. 154(b) by 325 days.

(21) Appl. No.: 17/701,059

(22) Filed: Mar. 22, 2022

Related U.S. Application Data

(60) Provisional application No. 63/249,939, filed on Sep. 29, 2021, provisional application No. 63/164,327, filed on Mar. 22, 2021.

(51) Int. Cl.
*B63H 20/10* (2006.01)
*B63H 20/02* (2006.01)

(52) U.S. Cl.
CPC ..... *B63H 20/10* (2013.01); *B63H 20/02* (2013.01)

(58) Field of Classification Search
None
See application file for complete search history.

(56) References Cited

U.S. PATENT DOCUMENTS 4,858,481 A 8/1989 Abraham
4,861,292 A 8/1989 Griffiths et al.
5,142,473 A 8/1992 Davis
5,782,662 A * 7/1998 Icenogle ..... B63H 20/106 248/641
6,126,498 A 10/2000 Icenogle et al.
7,146,786 B2 12/2006 Brandon
8,801,479 B1 * 8/2014 Quail ..... B63H 20/106 440/61 R
8,840,439 B1 * 9/2014 Wiatrowski ..... B63H 20/10 440/61 T
8,882,068 B2 * 11/2014 McGee ..... F16M 13/02 52/715
8,882,551 B1 11/2014 Quail
9,499,247 B1 * 11/2016 Wiatrowski ..... B63H 20/10
9,598,159 B2 * 3/2017 Nyren ..... B63H 20/06
9,745,036 B2 8/2017 Andrasko et al.
9,896,173 B2 2/2018 Baros et al.
9,896,174 B1 2/2018 Anschuetz
(Continued)

*Primary Examiner* — Steven M Marsh
(74) *Attorney, Agent, or Firm* — Christensen, Fonder, Dardi & Herbert PLLC; Andrew H. Auderieth; Douglas J. Christensen

(57) ABSTRACT

An adjustable and modifiable jack plate for attaching and positioning an outboard motor to the transom of a boat. The jack plate has a lift plate to attach the outboard motor, the lift plate having cylindrical polymer bearings on each of two lateral sides, the two bearings slidingly received in bearing retainers configured as a pair of C-shaped channel members, each channel member having a unitary vertical flange. Each flange being connected to a cooperating flange of a pair of L-shaped wing brackets, the cooperating flanges forming a lap joint. The L-shaped brackets are easily replaced with different L-shaped brackets having different set back distances for optimizing performance. A control system includes a user interface that has up and down buttons, a plurality of memory buttons for returning the lift plate to specific stored positions, and a numeric readout the provides a specific lift measurement in units such as inches.

19 Claims, 9 Drawing Sheets

(56) References Cited

U.S. PATENT DOCUMENTS

| | | | | |
|---|---|---|---|---|
| 10,118,681 | B1 | 11/2018 | Andrasko et al. | |
| 10,281,928 | B2 | 5/2019 | Behling et al. | |
| 2014/0359997 | A1* | 12/2014 | Witte, I | B63H 20/06 29/428 |
| 2017/0113772 | A1* | 4/2017 | Kumita | B63H 20/002 |
| 2017/0334535 | A1* | 11/2017 | Coller | B63H 20/32 |
| 2018/0154998 | A1 | 6/2018 | Baros et al. | |
| 2021/0394882 | A1* | 12/2021 | Waldvogel | B63H 20/10 |

* cited by examiner

JACK PLATE SYSTEM WITH PRECISION ADJUSTMENT AND OPTIMIZATION FEATURES

CROSS-REFERENCE TO RELATED APPLICATIONS

The present application claims the benefit of U.S. Provisional Patent Application No. 63/164,327, filed Mar. 22, 2021, and of U.S. Provisional Patent Application No. 63/249,939 filed Sep. 29, 2021, all of which are hereby incorporated by reference herein in their entireties.

FIELD OF THE DISCLOSURE

The present invention relates to systems for controlling and mechanisms for mounting outboard motors onto boats. More specifically, the present invention relates to a modular jack plate with precision vertical adjustment features for the height of an outboard motor.

BACKGROUND OF THE DISCLOSURE

During operation of a boat powered by an outboard motor, it is often desirable to raise or lower the outboard motor. For example, when operating a boat in shallow water or removing a boat from the water with a submersible boat trailer, it is often necessary to raise the motor so that the propeller and rudder are not damaged by the bottom of the body of water. In other instances, it may be desirable to raise the motor while operating the boat at high speeds to reduce the amount of drag created by the presence of the motor in the water. Raising the motor using the tilt control is not always optimal as the tilting rotates the force vector provided by the propeller in the water away from horizontal.

Jack plates are known that allow raising and lowering of outboard motors without adjusting the trim; see, for example, U.S. Pat. Nos. 8,267,025; 9,403,587; and 10,850,821 owned by the owner of this application. Such jack plates have provided enhanced boating performance to enthusiasts. When at speed, raised jack plates can remove much of the lower unit from the water reducing drag and increasing speed. Lowering the propeller in rough water provides smoother operation. The setback of the engine from the transom by the jack plate can allow the propeller to be placed in clear undisturbed water allowing the engine to work more efficiently and improve handling. However, setting the engine too far rearwardly can move the center of gravity of the engine too far rearwardly, raising the front of the boat and detrimentally effecting handling and performance. With current jack plates, modifying the setback provided by the jack plate usually involved installing spacers between the existing jack plate and the transom. Such spacers were typically C-shaped and added another set of fasteners and added weight. The additional fasteners were not always readily accessible and adjusting the setback was a difficult process.

The boating industry continues to seek further improvements in operation performance of boats and the associated equipment. Competitive fishing with increased television coverage and sizeable prize money purses has brought many new competitors to the sport along with significant expenditures on equipment for providing a competitive edge. From a performance perspective the capability to get from one spot to another with maximum ease and speed is paramount as seconds can matter in competitive fishing. Starting from a dead stop and getting to maximum speed in the minimal amount of time requires motor trim and height adjustments before starting, as the boat planes out, and during increases in speed. Typically, these adjustments are done on the fly and "by feel," without precision settings.

Considering the enhanced equipment associated with competitive fishing and demands of sophisticated users of boating equipment, any advancement in the precision operation of jack plates, and in the ease of tuning of jack plates, for example changing the setback distances for optimizing performance, would be well received by the sophisticated boating consumers. Moreover, any economies in manufacturing, simplifying designs without sacrificing performance, lowering manufacturing costs are always well received.

SUMMARY

An adjustable and modifiable jack plate for positioning and mounting an outboard motor to the transom of a boat. The jack plate has a lift plate to attach the outboard motor, the lift plate having cylindrical polymer bearings on each of two lateral sides, the two bearings slidingly received in bearing retainers configured as a pair of C-shaped channel members, each channel member having a unitary vertical flange. Each flange being connected to a cooperating flange of a pair of L-shaped wing brackets, the cooperating flanges forming a lap joint. The L-shaped brackets connectable to the boat transom and providing a setback distance for the outboard motor. A bridging member is fastened to each of the pair of L-shaped brackets and a linear actuator with an electric motor is connected to the bridging member and the lift plate to raise and lower the lift plate relative to the transom. The L-shaped brackets are easily replaced with different L-shaped brackets having a different set back distance for optimizing performance. A user interface has up and down buttons, a plurality of memory buttons for returning the lift plate to specific stored positions, and a numeric readout the provides a specific lift measurement in units such as inches.

A feature and advantage of embodiments is that the wing brackets connecting to the bearing retainers and the boat transom may be readily swapped out with different sized wing brackets and performance with both compared thereby providing an optimization of performance. A feature and advantage is that the bearing retainers and wing brackets connect with a lap joint that is robust and easily connected and disconnected with the bolt/washer/nut easily accessible.

Optimization during operation includes finding optimal trim vs. motor height positions, an optimal height position is more readily remembered and identified by a numerical readout that correlates to an actual physical measurement, rather than a relative indicator.

A feature and advantage of embodiments is that the engine height adjustment for starting from a dead stop can be initiated before the boat operator is in the driver's seat by simply pressing a memory button on a hand held wireless user interface. By the time the user is seated in the driver seat the engine is in the optimal position for an immediate start to get to a quick plane. Another touch of a memory button can put the engine height at an optimal position for a high speed trip to the next fishing spot.

In an embodiment, a jack plate comprises a mounting assembly comprising a first spacing bracket, a second spacing bracket, and extending between the first spacing bracket and the second spacing bracket. The first spacing bracket defines a first channel and the second spacing bracket defines a second channel with the first channel and the second channel opening toward one another. The jack plate further includes a lift plate assembly that is movable relative to the mounting plate. The lift plate assembly comprises a first slider slidingly received in the first channel, a second slider slidingly received in the second channel, and a lift plate extending between the first slider and the second slider. The jack plate comprises an actuator operably coupled between the mounting assembly and the lift plate assembly for moving the lift plate assembly relative to the mounting assembly.

In embodiments, a spring is operably couplable between the cross member and the lift plate assembly, the spring for applying a biasing force between the lift plate and the cross member for lessening loading on the powered actuator. This allows use of a lower powered actuator and/or can extend the life of the actuator. The spring can be an air spring, for example.

In embodiments, a jackplate system has a lift plate raisable and lowerable by way of an electric linear actuator and has a user interface that has an up and down controls, memory buttons for saved height positions, and a precise readout of height coupled with the encoder of the servomotor.

In embodiments, the jackplate performance can be optimized by replacing wing sections of the jack plate with longer or shorter wing sections without removing the outboard from the lift plate or the lift plate from the C-shaped channel members. The bolts and nuts connecting C-shaped channel members from the L-shaped wing brackets can be removed and the actuator may be disconnected by unscrewing the two screws that connect each wing bracket to the actuator bar. The inventor has discovered sufficient structural support is provided by the two L-shaped brackets bolted to the transom and a single cross member that connects the two L-shaped brackets, the single cross member also providing the fixed base, relative to the transom, for the linear actuator.

A feature and advantage of embodiments is that the operational axis of the linear actuator is substantially parallel to the operational axis of the lift plate providing a maximum efficiency in transferring the power of the actuator to the lifting force to raise and lower the outboard motor. In embodiments, swapping out wing brackets to adjust and optimize the setback position of the outboard motor does not alter the substantially parallel relationship of the lift plate operational axis and the linear actuator operational axis.

BRIEF DESCRIPTION OF THE DRAWINGS

Embodiments of the invention will be described with respect to the figures, in which like reference numerals denote like elements, and in which.

Figure 1:
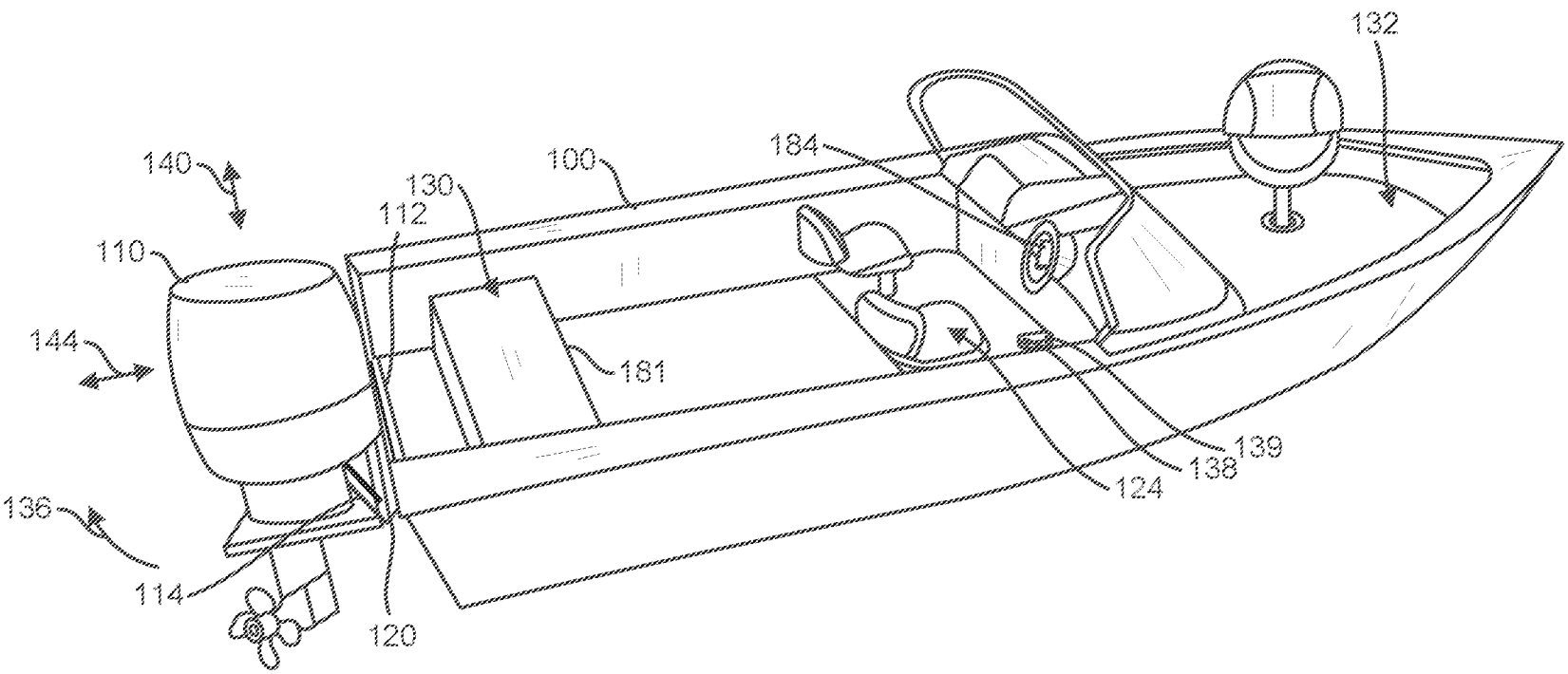
FIG. 1 is a perspective view of a boat with an outboard motor according to embodiments.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

DETAILED DESCRIPTION

Referring to FIG. 1, a boat 100 suitable for fishing has an outboard motor 110 mounted to the boat transom 112 by way of a jack plate 120. The boat has the driver's seat 124 defining the main boat operator position for driving the boat, and has alternative positions 130, 132 that the boat operator may take when, for example, fishing. The operator will be sitting or standing in such alternative positions, probably standing when in competitive fishing scenarios. The outboard motor 110 has a conventional tilt mechanism 114, a hydraulic cylinder for example, that rotates the lower end of the motor upwardly as illustrated by arrow 136. A tilt control 138 can be on the throttle stick 139. The jack plate raises and lowers the engine as indicated by the arrow 140. The jack plate can be modified adjusting the setback of the engine with respect to the transom as indicated by the arrow 144.

Figure 2:
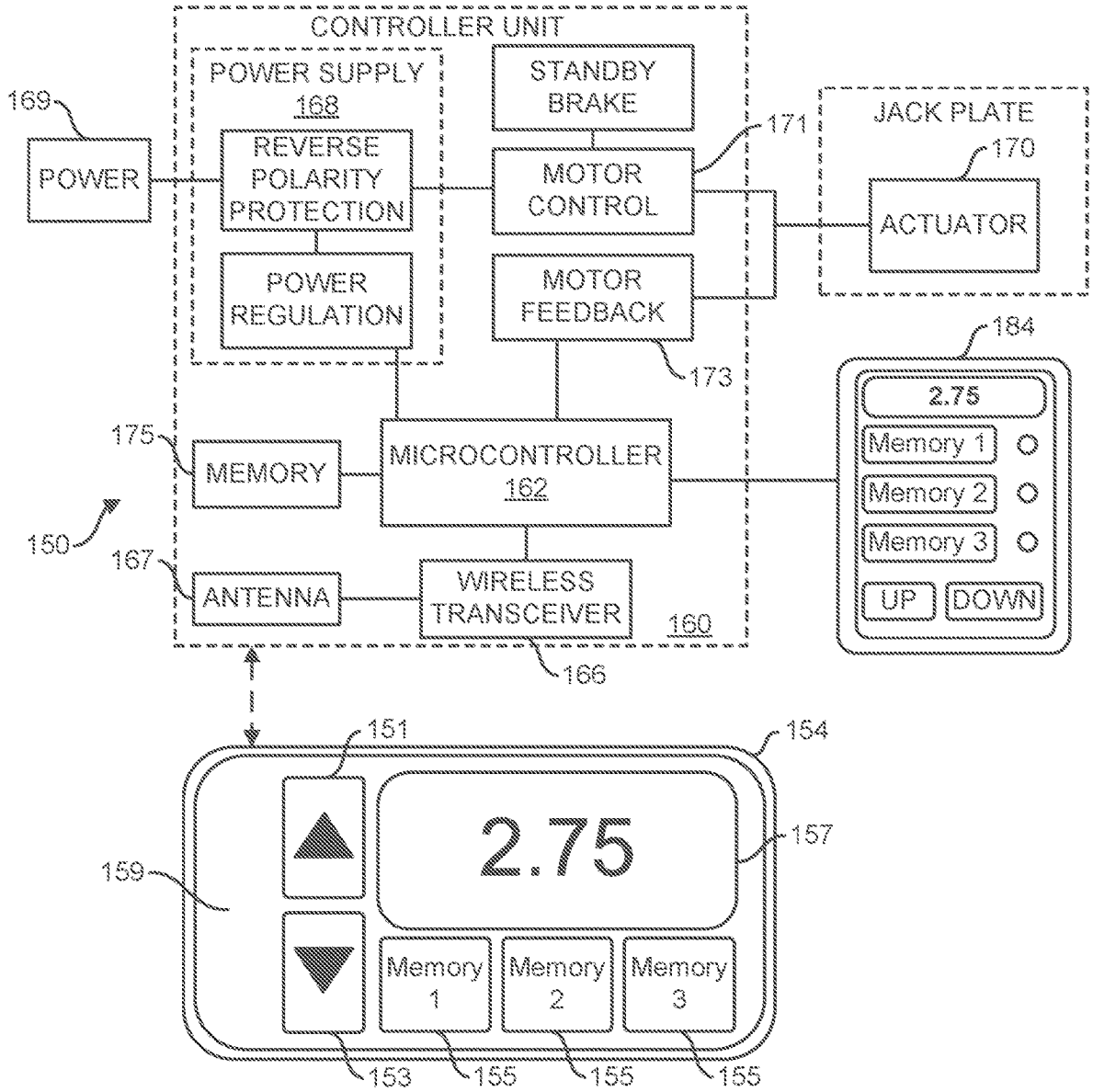
FIG. 2 is a diagrammatic view of a jack plate control system in accord with embodiments.
Figure 3:
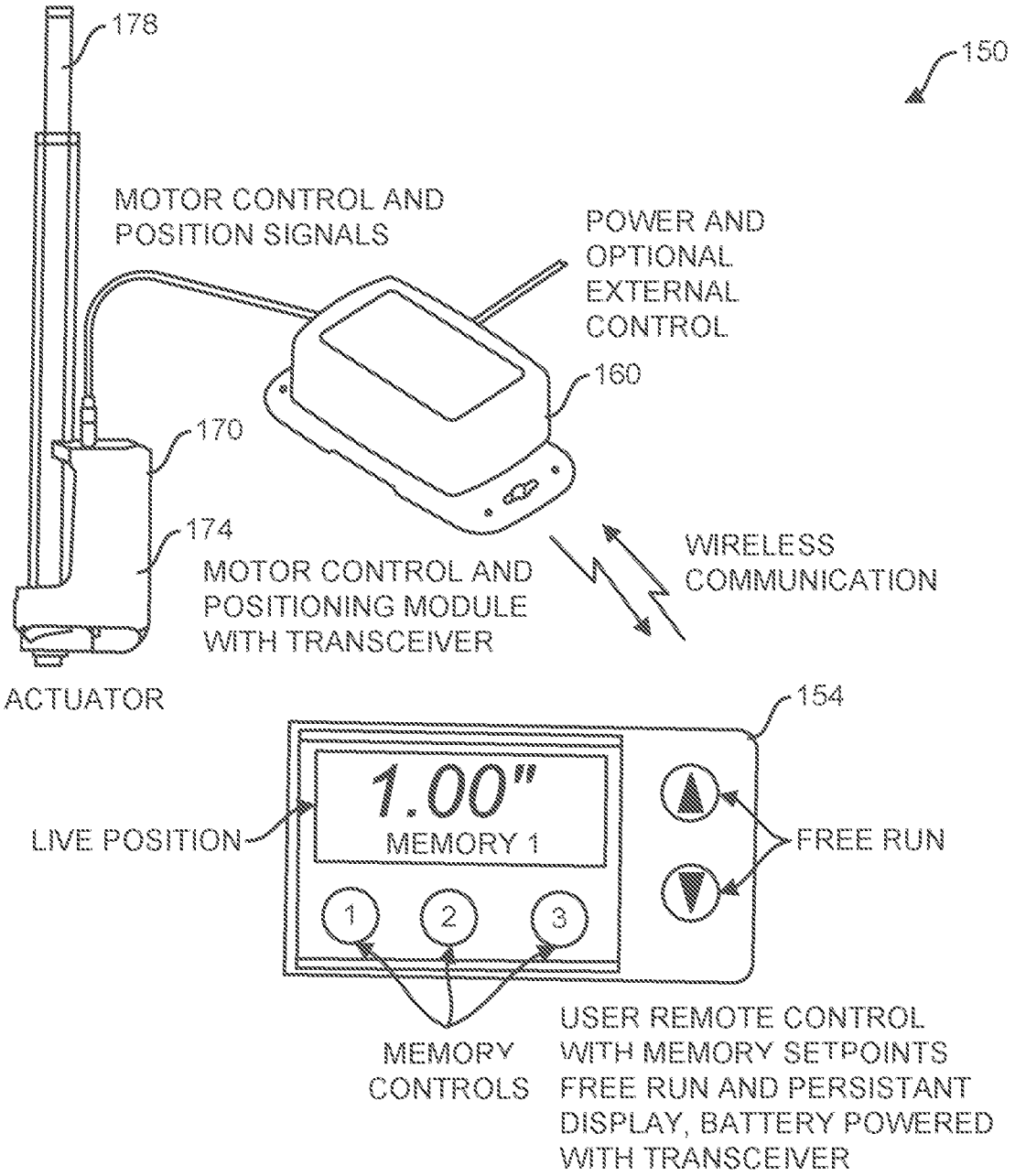
FIG. 3 is a pictorial diagrammatic view of the control system connecting to the linear actuator of the jack plate.
Figure 5:
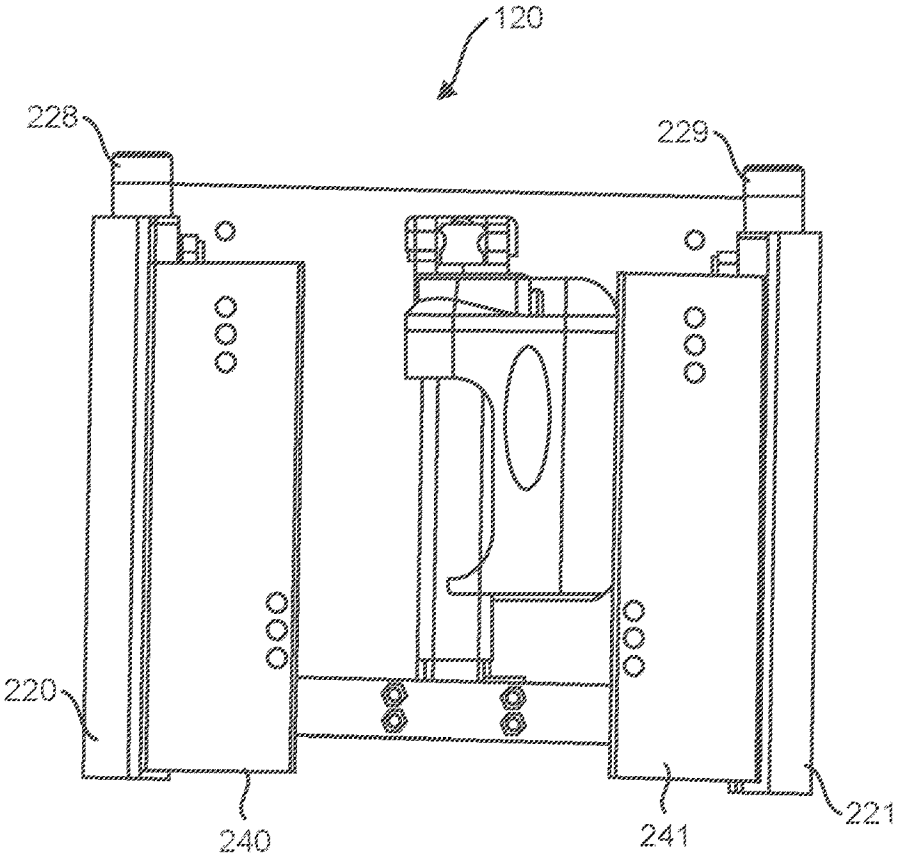
FIG. 5 is a front elevational view of the jack plate of FIG. 4.
Figure 4:
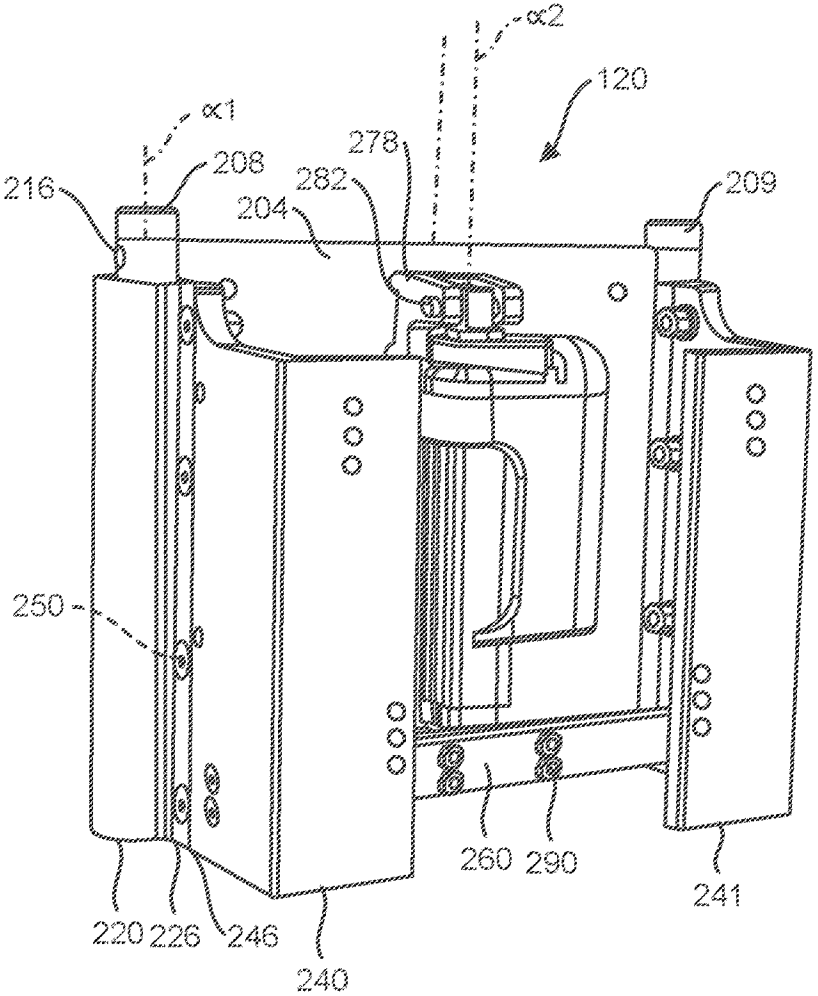
FIG. 4 is a front perspective view of a jack plate in accord with embodiments.
Figure 6:
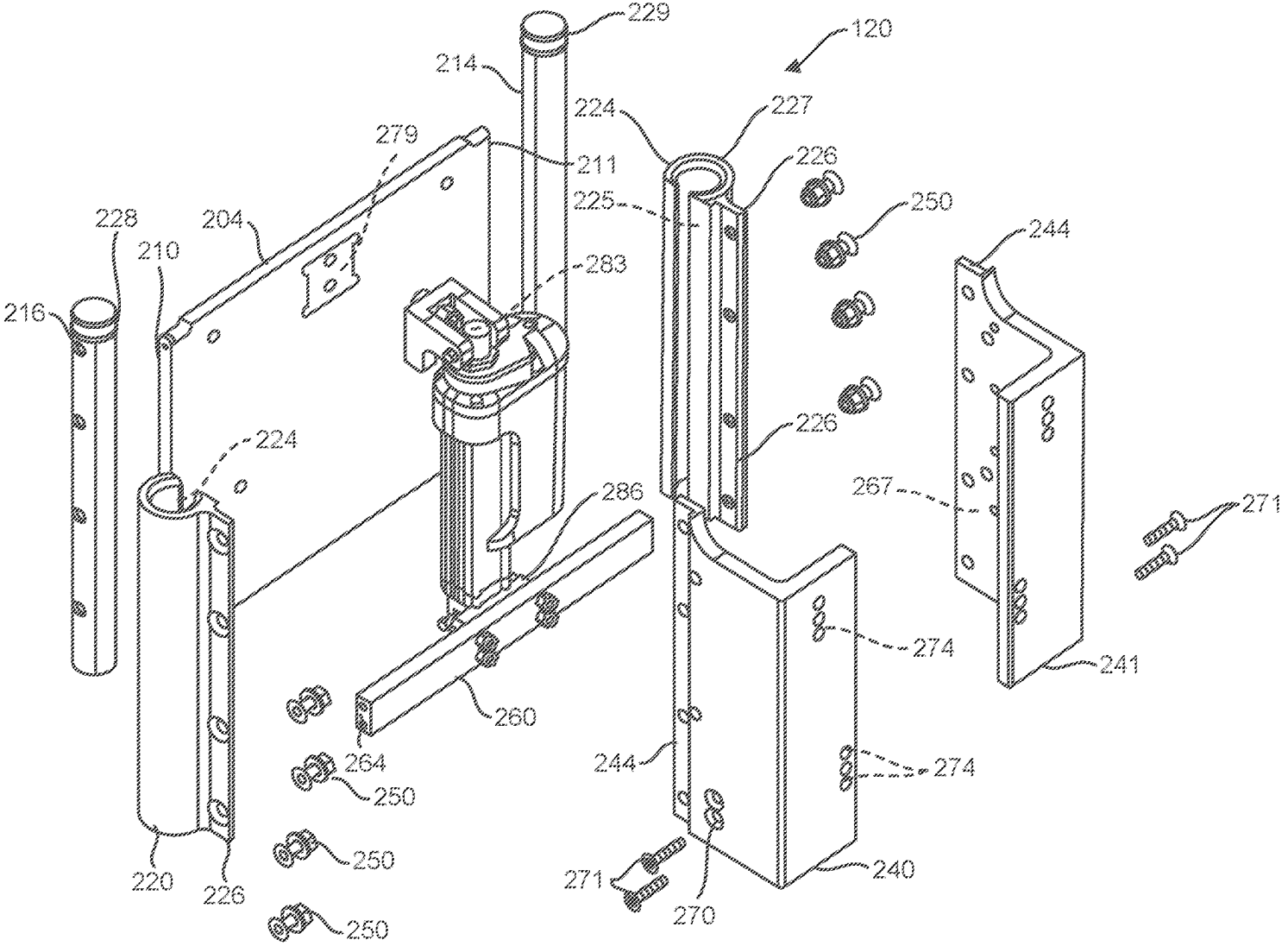
FIG. 6 is an exploded view of the jack plate of FIG. 4.

Referring to FIGS. 1-3, the jack plate is controlled by a control system 150 that includes a user interface 154, controller module 160 with control processor or microcontroller 162 and transceiver 166. The controller module 160 has an internal power supply 168 powering microcontroller 162 and which is coupled to the boat power supply 169. Power supply 168 is electrically connected to a motor control 171, which in turn is electrically connected to a linear actuator 170 of the jack plate, described in further detail below, for controlling the electric motor 174 of the linear actuator. Motor control 171 and linear actuator 170 are further connected with motor feedback unit 173 for receiving position signals with respect to the position of the shaft 178 of the linear actuator. Motor feedback unit 173 can relay such position signals back to microcontroller 162 for further operations, such as storing the position in a memory unit 175 or displaying the position on user interface 154. The boat operator can utilize the user interface 154 from anywhere on the boat including the identified positions 124, 130, 132. The control module can be suitably located such as under the bench 181. An additional user interface 184 can be hard wired as well and may be mounted at the main operator's position proximate to the driver's seat, for example, on the steering wheel. In embodiments, additional user interface may be limited to only directional controls.

User interface 154 may be a handheld battery operated device. In embodiments, user interface 154 may have a width between 2 and 3 inches and a length between 4 and 5 inches. In embodiments, user interface 154 may have a width of about 2.24 inches and a length of about 4.1 inches.

User interface 154 may include directional controls 151, 153, a plurality of memory buttons 155, and a display 157. In embodiments, directional controls may include an "up" control 151 and a "down" control 153. In embodiments, user interface 154 may include one, two, or three memory buttons 155. In embodiments, user interface 154 may include more than three memory buttons. Display 157 may be any suitable unit capable of displaying numerals for indicating a position of linear actuator 170 or other error codes or informational data such an analog or LED display. In embodiments, display 157 may be a bistable LCD device such as an ePaper or eInk display. Such displays require power only to set an image on the display, and do not require any further power to hold that image in place. Accordingly, an ePaper or eInk display could, for example, display the current position of the linear actuator to the driver without draining the user interface 154 battery.

User interface 154 remains in an "off" state until a button 151, 153, 155 is pressed. Once a button 151, 153, 155 is pressed, if the user interface 154 does not receive a return message from controller module 160, user interface 154 will display "LINK ERROR," or some other message indicating an error, on display 157. For example, "LINK ERROR" would be shown on display 157 if there is no power to controller module 160. In embodiments, "LINK ERROR" is displayed 10 seconds after pressing any button 151, 153, 155 and not receiving a message from controller module 160. In embodiments, user interface 154 checks for signals from wireless transceiver 166 about 10 times per second. User interface 154 may communicate with wireless transceiver 166 through known protocols such as RF, Bluetooth, WiFi, or the like. Controller unit 160 responds to the initial button press with a signal indicating a current status. The status may either be "lost" or an indicator that controller unit 160 knows its current position. If controller unit 160 knows its position, control unit 160 enters into a normal operating mode. If the actuator control is lost, the display 157 will show "HOMW," or some similar indicator, at which point the linear actuator 170 can only be moved down to the 0.00" point. Once motor feedback 173 detects the zero point, user interface 154 is set to a normal operating mode During normal operation the user interface 154 will display the jack plate position in ¼" increments. Pressing and holding either up or down buttons 151, 153 will move the linear actuator 170 smoothly from top to bottom. Once up or down buttons 151,153 are released, the motor control 171 stops linear actuator 170 at the next closest ¼". For example, if the jack plate is at 1.00" and moving down towards 0.00", and if display 157 shows 0.75" when down button 153 is released, the transom will stop at 0.50". Pressing one of the plurality of memory buttons 155 will automatically send the jack plate a predefined position associated with the button 155, regardless of whether the predefined position is up or down from the present position of the jack plate. Positions are associated with buttons 155 and stored into memory 175 by first using the directions buttons 151,153 to move the jack plate up or down to the desired location. Once the jack plate is in the desired position, pressing and holding the memory button 155 stores the position into memory 175 and associates the stored position with the memory button 155. Subsequently pressing memory button 155 will return the jack plate to the associated stored position.

At any point that the jack plate is in motion, should the jack plate stop moving due to unforeseen circumstances, the display 157 will show "STALL," or some similar indicator message. Unforeseen circumstances may include, for example, a jam of the actuator or shaft, a loss of communication, a wire break, or the like. Pressing any button 151, 153, 155 on the user interface 154 will cause controller unit 160 to clear the stall and move the jack plate in a manner appropriate for the button pressed. If at any time communication is lost for more than 100 attempts the display 157 will show "LINK ERROR," or some message indicating an error. In the event of any "LINK ERROR," the user interface 154 enters a sleep mode. The user interface 154 may also enter sleep mode after 15 seconds of inactivity. When in sleep mode, pressing any button 151,153,155 transitions the user interface 154 into a wake mode, which then attempts to find the controller unit 160 and reestablish communication with wireless transceiver 166.

In embodiments, buttons 151,153,155 may be incorporated into a circuit board, in further communication with a microprocessor and a battery. Display 157 may also be integrated into the circuit board. In embodiments, graphic overlay 159 may be placed over the circuit board and buttons 151,153,155. Graphic overlay 159 may incorporate indicia indicated the function of buttons 151,153,155. For example, directional button 151 may have the word "UP" or a graphical indicator, such as an upward pointing arrow, printed on the graphic overlay 157. In embodiments, portions of graphic overlay 159 over the buttons 151,153,155 may use a pillow emboss to create a tactile feel when operating user interface 154. While steering a boat, particularly in competition settings, it can be beneficial to quickly operate user interface 154 to move the jack plate by feel without the need to avert ones gaze from the water or other surroundings. In embodiments, a pillow emboss may be between 0.005 and 0.020 inches high. In embodiments, a pillow emboss may be between 0.010 and 0.015 inches tall. In embodiments, additional support structure, such as metal domes, may be used surround buttons 151,153,155. In embodiments, graphic overlay 159 may be laminated, or incorporate materials such as Melinex® film, to protect user interface 154 from water or other harsh conditions experienced while boating. The following U.S. patents and U.S. patent publications contain content, aspects, components and functionalities relating to or applicable to control of jack plates and/or outboard motors and are incorporated by reference herein in their entireties for all purposes: U.S. Pat. Nos. 9,745,036; 10,281,928; 9,896,173; 8,882,551; 6,126,498; 4,861,292; 7,146,786; 4,858,481; 5,142,473; 9,896,174; 10,118,681; and US Patent Publication 20180154998.

Referring to FIGS. 4-11, various views illustrate the jack plate 120 in accord with embodiments. The jack plate generally has a lift plate 204 that has a pair of sliders 208 configured as cylindrical polymeric bearings 208, 209 fixed on opposing lateral edge portions 210, 211 of the lift plate. The edge portions are received in slots 214 of the bearings 208 and may be retained by an interference fit and/or threaded fasteners 216 or other means. The lift plate with the bearings fixed thereto is captured and slidingly constrained by bearing retainers 220, 221 each having a C channel portion 224 and a unitary flange 226. The bearing retainers 220, 221 are mirror images of each other with the slots 224, 225 defined by the C channel portion opening toward each other and capturing the lift plate edge portions 210, 211 and bearings 208, 209. Downward sliding is limited by the diametrically enlarged portions 228, 229 of the cylindrical bearings.

Figure 7:
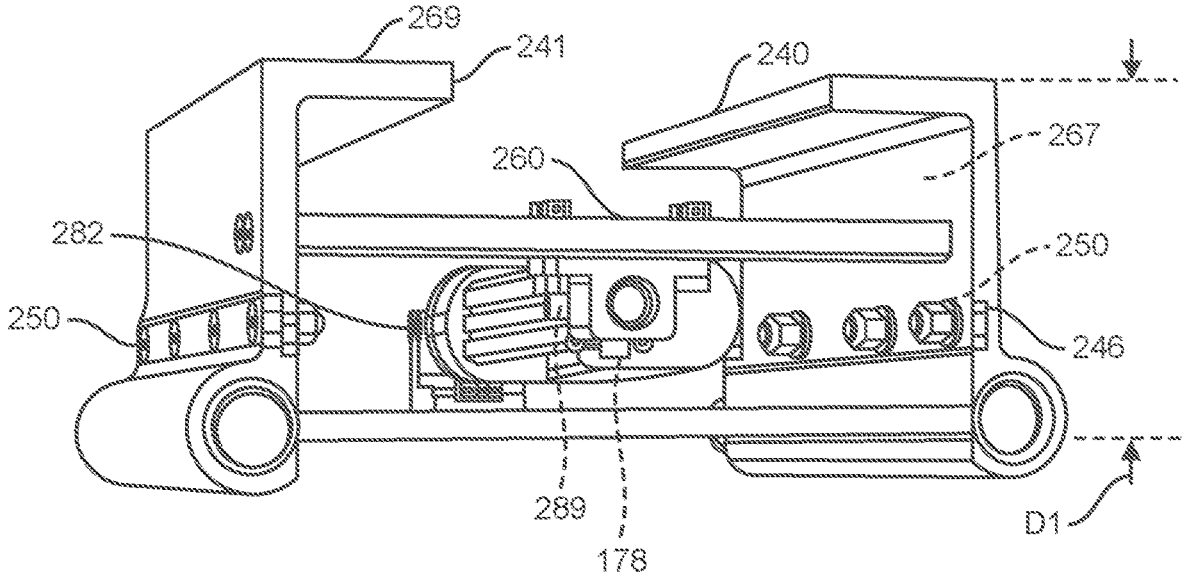
FIG. 7 is a bottom perspective view of the jack plate of FIG. 4.
Figure 8:
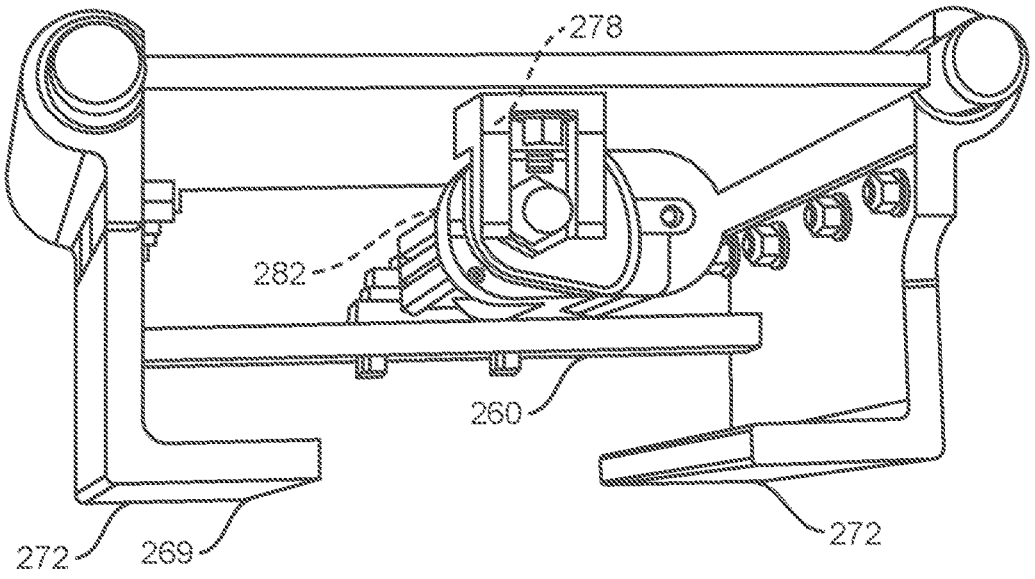
FIG. 8 is a top perspective view of the jack plate of FIG. 4.
Figure 9:
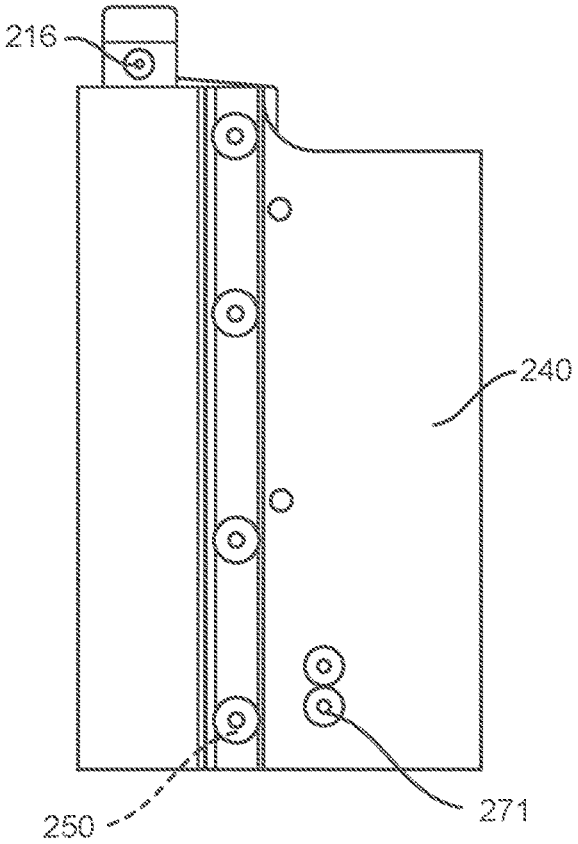
FIG. 9 is a side elevation view of the jack plate of FIG. 4
Figure 10:
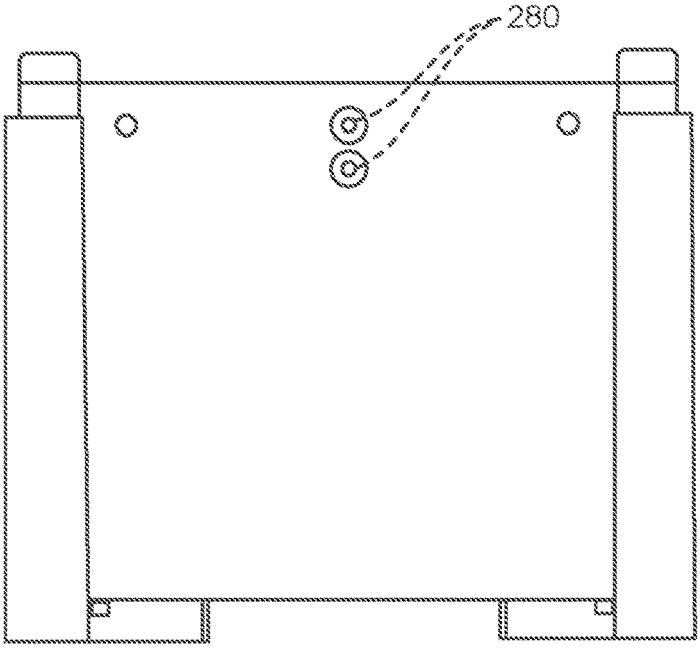
FIG. 10 is a back elevation view of the jack plate shown in FIG. 4.

The bearing retainers are secured to L-shaped wing brackets 240, 241 at the flange 226 which cooperates with a corresponding flange 244 on the wing brackets to form a lap joint 246. A plurality of linearly aligned holes 248 in the bearing retainer flange match with a plurality of linearly aligned holes 249 in the wing bracket flange 244 and a plurality of nut/bolt/washer assemblies 250 secure the joint 246. A bridging or cross member 260 extends between the pair of wing brackets 240, 241 and has a rectangular shape from the end view with planar end surfaces 264 that interface with the planar inside surfaces 267 of the wing brackets. The cross member is spaced rearwardly (away from the boat transom) from the shorter leg 269 of the L-shaped wing brackets as best shown in FIGS. 7 and 8. The cross member having threaded holes 270 for receiving screws 271 securing the wing brackets to the cross member 260. The L-shaped wing brackets each have a forward planar transom engaging surface 272 with holes 274 for matching with like holes on the transom and connection with bolt/nut/washer combinations. The inventor has found surprisingly that this single cross member component and this engagement, without the conventional forward transom plate, provides adequate structural support and connection between the transom and the jack plate comparable to the configuration with transom plates bridging between the forwardmost portions of the side members that connect to the transom. The lap joint 246 and the flush attachment of the short leg portion of the wing brackets to the transom with bolt/nut/washer combinations fixes the C channel portions with respect to the boat transom and boat providing the fixed vertical axis $\alpha 1$ of the lift plate motion which corresponds to the motion of the attached outboard motor with respect to the boat as illustrated by arrow 140 of FIG. 1.

The linear actuator 170 extends between the lift plate 204 and the cross member 260. A mounting bracket 278 fits into a recess 279 on the lifting plate and is secured to the lifting plate 204 with a plurality of bolt/nut/washer combinations 280. A pin 282 pivotally secures the upper connecting shaft 283 of the actuator to the upper mounting bracket 278 and the pin may be held in place with a cotter key. A lower bracket 286 is connected to the cross member 260 with four bolt/washer/nut combinations 290. The lower bracket is secured to the lower actuator shaft 178 by way of pin 289.

Suitable electro-mechanical linear actuators are available through Linak A/S of Nordborg, Denmark. See U.S. Pat. Nos. 10,516,318; 9,312,738; 8,725,438; and 8,302,227, all of which are incorporated by reference herein for all purposes.

The configuration of the upper bracket and lower bracket positions the actuator axis $\alpha 2$ to be substantially parallel of the lift plate operational axis $\alpha 2$ providing for maximum power transfer and efficiency from the linear actuator to the lift plate. In embodiments, "substantially parallel" means the axis $\alpha 1$ and $\alpha 2$ are within 7 degrees. In embodiments, "substantially parallel" means the axis $\alpha 1$ and $\alpha 2$ are within 4 degrees. In embodiments, "substantially parallel" means the axis $\alpha 1$ and $\alpha 2$ are within 2 degrees. Even when the L-brackets are swapped out, as described below, this substantially parallel orientation is maintained, thereby continuing to provide the same maximum lifting power and efficiency from the actuator.

In embodiments, hydraulic linear actuators may be utilized rather than the electromechanical actuators illustrate and/or described herein.

Figure 11:
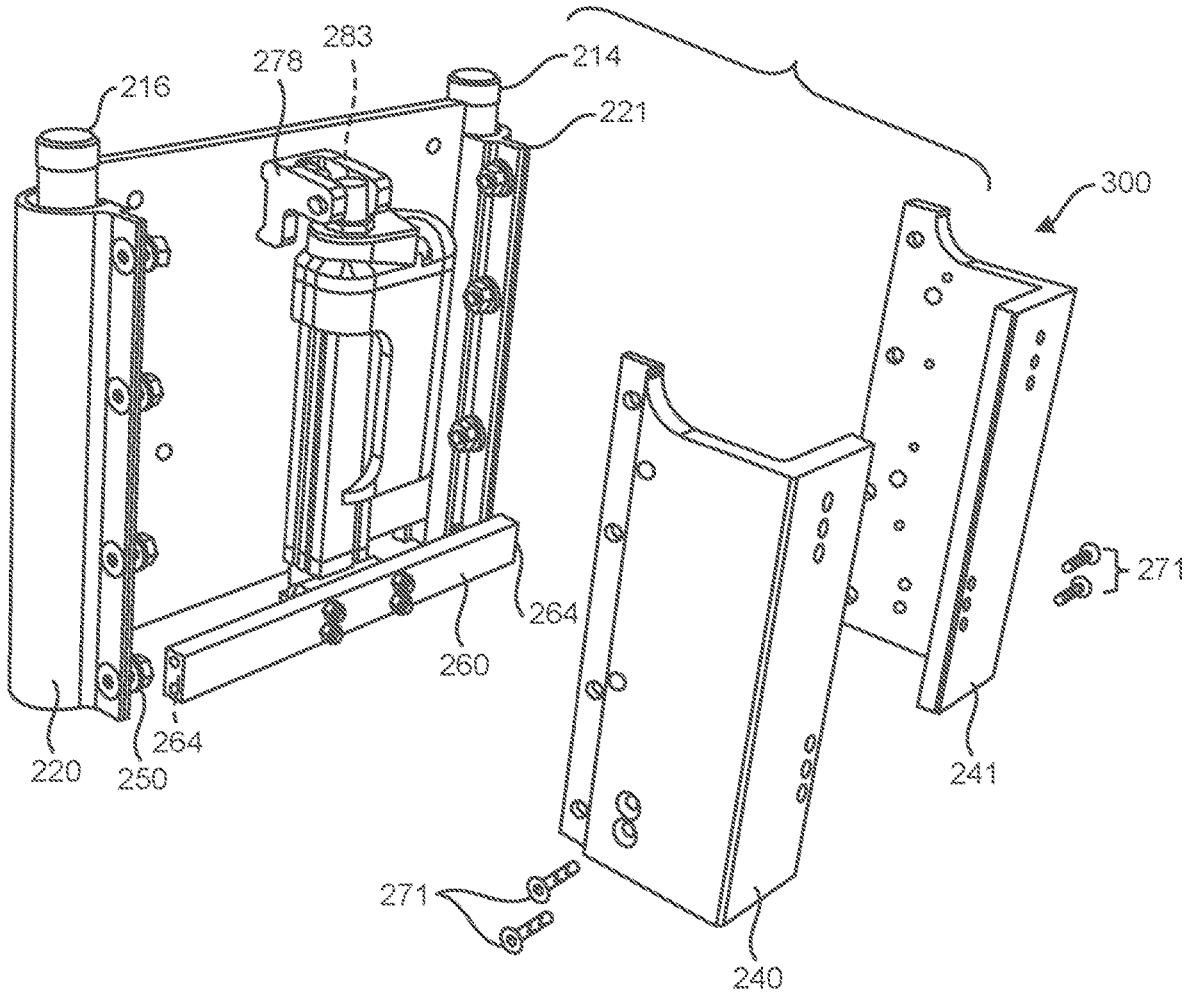
FIG. 11 is a partial exploded view of a jack plate illustrating the removal of wing brackets for changing the setback.
Figure 12:
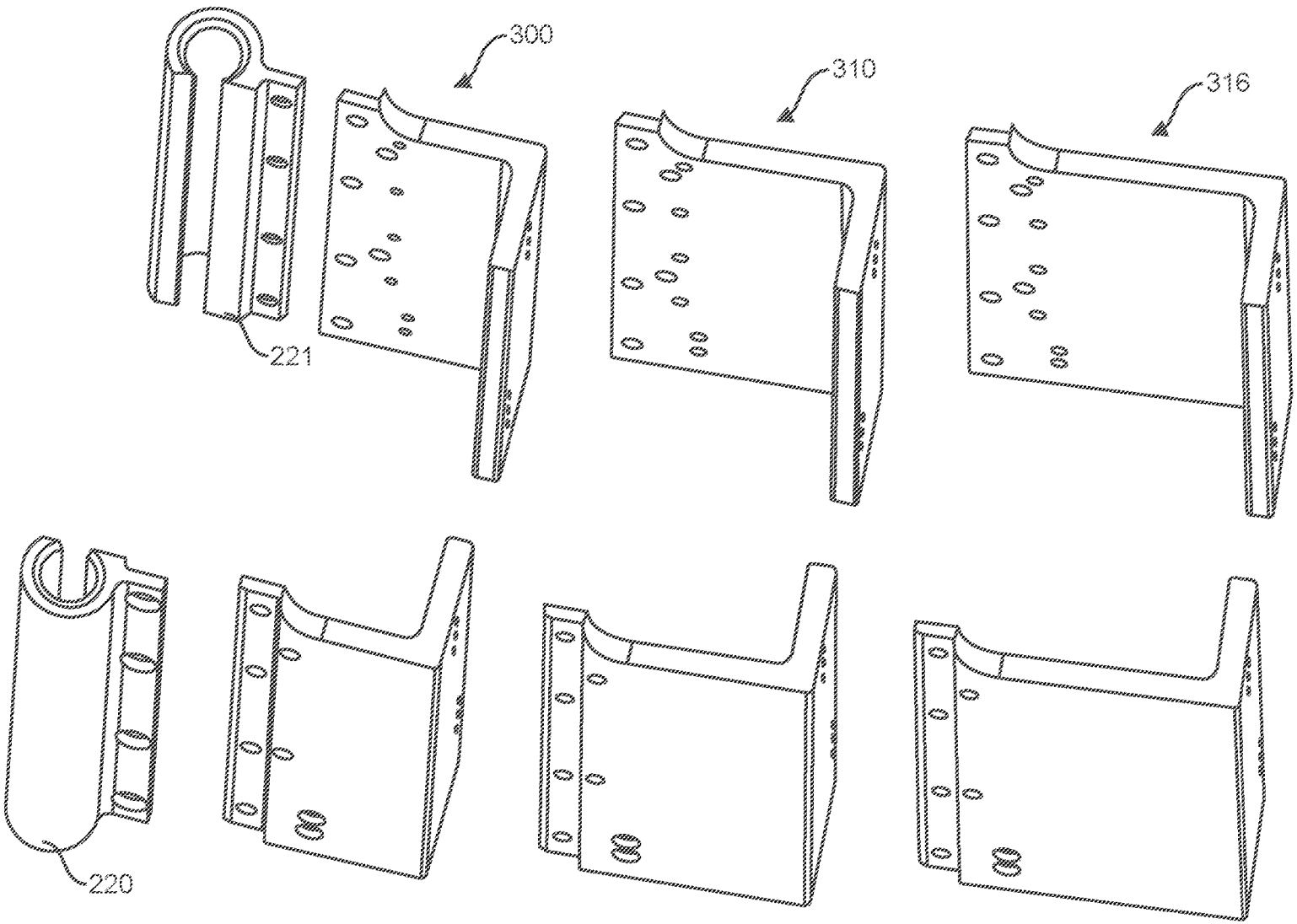
FIG. 12 is a perspective view showing a pair of bearing retainers and three different wing brackets that can connect thereto providing different levels of setback.

Referring to FIGS. 11 and 12, with an unweighting of the outboard motor, adjustment for optimization of the setback can be readily accomplished. The setback being defined as the added forward backward distance D1 provided by the jack plate, see FIG. 7. The pair 300 of L-shaped wing brackets can be removed by removing the bolt/nut/washer combinations 250 at the lap joint 246 and the screws 271 connecting the wing brackets 240 to the cross member combinations. A second pair 310 of differently sized, that is providing a different set back distance, wing brackets can be installed by inserting the second pair and replacing the bolt/nut/washer combinations 246 and screws 250. A third pair 316 can also be swapped out and the relative performance of each compared. Each wing bracket of each pair having the identical flanges configured for making the lap joint connection.

In embodiments, gas springs as illustrated in U.S. Pat. No. 10,850,821 may be used to reduce the required power of the linear actuator and/or extend the potential life of same. Said patent, owned by the owners of this application, is incorporated by reference herein for all purposes.

The following U.S. patents and U.S. patent publications contain content, aspects, structure, components, and functionalities relating to or applicable to jack plates and/or outboard motors and are incorporated by reference herein in their entireties for all purposes: U.S. Pat. Nos. 8,657,637; 4,995,839; 5,782,662; 5,704,308; 5,017,165; 9,284,031; 9,896,173; 8,267,025; 9,403,587; and US20100127150.

Although the present invention has been described with reference to particular embodiments, those skilled in the art will recognize that changes may be made in form and substance without departing from the spirit and scope of the invention. The embodiments described above are intended to be illustrative and not limiting.

The invention claimed is:

1. A performance optimizable remotely controllable jack plate for precision control of raising and lowering an outboard motor on a boat, the remotely controllable jack plate comprising:

a lift plate for receiving the outboard motor, the lift plate having a pair of lateral parallel edge portions secured in a pair of cylindrical polymeric bearings; each of the lift plate edge portions and each of the cylindrical bearings slidingly captured in one of a pair of mirror image C-channel member, each of the C-channel members having a first flange connection portion with a plurality of aligned holes;

a pair of mirror image L-shaped wing brackets having a second flange connection bracket with a plurality of aligned holes, each of the pair of mirror image L-shaped brackets attached to one of the C-channel members with the second flange member connecting to the first flange member defining a lap joint;

a cross member extending between the pair of L-shaped wing brackets and fastened to each L-shaped wing bracket; and a linear actuator comprising an electric motor and an extendable and retractable shaft, the linear actuator having an encoder providing position information of the extendable and retractable shaft, the linear actuator positioned between the cross member and the lift plate whereby when the shaft extends the lift plate raises with respect to the C channel members and connected L-shaped wing brackets.

2. The performance optimizable remotely controllable jack plate of claim 1, further comprising a control system for operating the linear actuator, the control system including a controller with a control processor, and a user interface with at least an up button and a down button.

3. The performance optimizable remotely controllable jack plate of claim 2, wherein the user interface is wireless and has at least three position memory buttons, and wherein the control processor is configured to operate the actuator when there is a single press of an up button on the user interface and the actuator raises the lift plate a distance dependent upon the time duration of the single press.

4. The performance optimizable remotely controllable jack plate of claim 1, wherein the pair of wing brackets have a set back distance and the wing brackets may be replaced by a second set of wing brackets having a different set back distance, or a third set of wing brackets having a further different set back distance.

5. The performance optimizable remotely controllable jack plate of claim 1, wherein each of the wing brackets may be removed by removing a plurality of fasteners at the connection with the C-channel member and one or more fasteners connecting each of the wing brackets to the cross member.

6. The performance optimizable remotely controllable jack plate of claim 1, further comprising a spring operably couplable between the cross member and the lift plate, the spring for applying a biasing force between the lift plate and the cross member for lessening loading on the linear actuator.

7. A performance optimizable remotely controllable jack plate for precision control of raising and lowering an outboard motor on a boat, the remotely controllable jack plate comprising:

a lift plate for receiving the outboard motor, the lift plate having a pair of lateral parallel edge portions secured to a pair of bearings; each of the pair of bearings slidingly captured in a respective pair of bearing retainers, each of the bearing retainers having a first flange connection portion with a plurality of aligned holes;

a linear actuator with an extendable and retractable shaft, the linear actuator positioned between a cross member and the lift plate whereby when the shaft extends the lift plate raises; and a control system including a hand held user interface that communicates with a controller unit, the controller unit connecting to the linear actuator and a power supply, the controller unit configured to operate the linear actuator based on signals received from the hand held user interface, wherein the user interface comprises at least one directional button and at least one memory button, and wherein a single press of the at least one directional button extends or retracts the actuator a distance dependent upon a duration of the single press.

8. The performance optimizable remotely controllable jack plate of claim 7, wherein a first memory button will, when pressed for a predetermined duration of time, store a first retained position corresponding to a current position of the linear actuator; wherein when the actuator is not at the current position and the first button is pressed again for a duration of time less than the predetermined duration of time, the actuator will move to the first retained position.

9. The performance optimizable remotely controllable jack plate of claim 8, wherein a second memory button will, when pressed for a predetermined duration of time, store a second retained position corresponding to the current position of the linear actuator; wherein when the actuator is not at the current position and the second button is pressed again for a duration of time less than the predetermined duration of time, the actuator will move to the second retained position.

10. The performance optimizable remotely controllable jack plate of claim 7, further comprising a pair of mirror image wing brackets having a second flange connection bracket with a plurality of aligned holes, each of the pair of mirror image wing brackets attached to one of the bearing retainers with the second flange member connecting to the first flange member of one of the bearing retainers; and a cross member extending between the pair of wing brackets and fastened to each wing bracket.

11. The performance optimizable remotely controllable jack plate of claim 10, wherein the pair of mirror image wing brackets have a set back distance and the mirror image wing brackets may be replaced by a second set of mirror image wing brackets having a different set back distance.

12. The performance optimizable remotely controllable jack plate of claim 11, wherein each of the mirror image wing brackets may be removed by removing a plurality of fasteners at the respective flange member and one or more fasteners connecting the respective mirror shaped wing bracket to the cross member.

13. The performance optimizable remotely controllable jack plate of claim 7, wherein holding a directional up button or down button actuates the actuator until the directional button is released or the linear actuator has reached a limit of extension or retraction.

14. The performance optimizable remotely controllable jack plate of claim 7, wherein the user interface has a bistable display depicting a numerical readout of a position of the actuator and/or a numerical readout of a lift plate.

15. The performance optimizable remotely controllable jack plate of claim 14, wherein the numerical readout corresponds to a specific distance above a datum level.

16. The performance optimizable remotely controllable jack plate of claim 7, wherein the user interface is wireless and may be hand held.

17. The performance optimizable remotely controllable jack plate of claim 16, wherein the control system has a second user interface mounted within reach of a user seated on the boat driver's seat.

18. The performance optimizable remotely controllable jack plate of claim 17, wherein the second user interface is hard wired to the controller unit.

19. The performance optimizable remotely controllable jack plate of claim 7, wherein the linear actuator has an encoder that provides electrical signals indicative to a position or movement of the shaft.

* * * * *